US012129538B2

(12) United States Patent
Böhlke et al.

(10) Patent No.: US 12,129,538 B2
(45) Date of Patent: Oct. 29, 2024

(54) USE OF A COPPER ALLOY

(71) Applicant: KME Special Products GmbH, Osnabrück (DE)

(72) Inventors: Peter Böhlke, Westerkappeln (DE); Hans-Günter Wobker, Bramsche (DE); Hark Schulze, Hasbergen (DE)

(73) Assignee: cunova GmbH, Osnabrück (DE)

( * ) Notice: Subject to any disclaimer, the term of this patent is extended or adjusted under 35 U.S.C. 154(b) by 0 days.

(21) Appl. No.: 17/274,095

(22) PCT Filed: Sep. 13, 2019

(86) PCT No.: PCT/DE2019/100816

§ 371 (c)(1),
(2) Date: Mar. 5, 2021

(87) PCT Pub. No.: WO2020/052714

PCT Pub. Date: Mar. 19, 2020

(65) Prior Publication Data

US 2021/0214828 A1 Jul. 15, 2021

(30) Foreign Application Priority Data

Sep. 14, 2018 (DE) ..... 10 2018 122 574.1

(51) Int. Cl.
*C22F 1/08* (2006.01)
*C22C 9/00* (2006.01)

(52) U.S. Cl.
CPC . *C22F 1/08* (2013.01); *C22C 9/00* (2013.01)

(58) Field of Classification Search
CPC ..... C22F 1/08; C22C 9/00; B22D 11/059
See application file for complete search history.

(56) References Cited

U.S. PATENT DOCUMENTS

| | | | | |
|---|---|---|---|---|
| 5,069,270 | A * | 12/1991 | Gravemann | B22D 11/066 164/138 |
| 5,798,008 | A * | 8/1998 | Nogami | C22F 1/08 148/683 |
| 2004/0238501 | A1 | 12/2004 | Kawazoe et al. | |
| 2010/0000860 | A1 | 1/2010 | Yuan et al. | |
| 2015/0376755 | A1 | 12/2015 | Kim et al. | |
| 2016/0186294 | A1* | 6/2016 | Maki | C22C 9/00 428/673 |

FOREIGN PATENT DOCUMENTS

| | | | | |
|---|---|---|---|---|
| CN | 1730690 | | | 2/2006 |
| CN | 104846234 | A | * | 8/2015 |
| CN | 104846234 | | | 1/2017 |
| CN | 104846234 | B | * | 1/2017 |
| DE | 2 243 731 | | | 3/1974 |
| DE | 31 04 960 | | | 8/1982 |
| DE | 102004025600 | | | 12/2004 |
| EP | 0250001 | B1 | | 12/1991 |
| EP | 1 170 074 | | | 1/2002 |
| JP | S58210140 | A | | 12/1983 |
| JP | S61-288036 | A | | 12/1986 |
| JP | S62-182238 | A | | 8/1987 |
| JP | H07-054079 | A | | 2/1995 |
| JP | H0754079 | A | | 2/1995 |
| JP | 2014-19880 | | | 2/2014 |
| JP | 2015-190044 | | | 11/2015 |
| RU | 2 477 194 | | | 3/2013 |
| RU | 2 544 978 | | | 3/2015 |
| WO | WO 2004/074526 | | | 9/2004 |
| WO | WO 2011093310 | A1 | | 8/2011 |

OTHER PUBLICATIONS

Zhu et al., CN104846234A—machine translation (Year: 2015).*
Chinese Search Report Issued on Oct. 11, 2021 by the Chinese Patent Office in counterpart Application No. 2019800294415.
Translation of Chinese Search Report issued on Oct. 11, 2021 by the Chinese Patent Office in counterpart Application No. 2019800294415.
Russian Search Report issued by the Russian Patent Office in Russian counterpart Application No. 2020138873/05(072115) on Jan. 11, 2021.
Translation of Russian Search Report Issued by the Russian Patent Office in Russian counterpart Application No. 2020138873/05(072115) on Jan. 11, 2021.

* cited by examiner

*Primary Examiner* — John A Hevey
(74) *Attorney, Agent, or Firm* — Henry M. Feiereisen LLC

(57) ABSTRACT

A copper alloy for use as material for a casting mold or a casting mold component selected from the group consisting of mold plate, mold tube, casting wheel, casting drum, casting roller, and melting crucible. The copper alloy includes, in percent by weight (proportion by mass of the melt analysis in %): silver (Ag) 0.020-0.50, zirconium (Zr) 0.050-0.50, phosphorus (P) not more than 0.060, chromium (Cr) not more than 0.005, balance copper (Cu) and other alloying elements including unavoidable impurities, with a proportion of the other alloying elements being less than or equal to (≤) 0.50.

5 Claims, No Drawings

USE OF A COPPER ALLOY

CROSS-REFERENCES TO RELATED APPLICATIONS

This application is the U.S. National Stage of International Application No. PCT/DE2019/100816, filed Sep. 13, 2019, which designated the United States and has been published as International Publication No. WO 2020/052714 A1 and which claims the priority of German Patent Application, Serial No. 10 2018 122 574.1, filed Sep. 14, 2018, pursuant to 35 U.S.C. 119(a)-(d).

BACKGROUND OF THE INVENTION

The invention relates to a use of a copper alloy.

Copper is a material having a very high conductivity for heat and electricity, excellent corrosion resistance, moderate strength and good formability. The properties of copper alloys are adjusted for a specific application by addition of alloying elements.

Copper alloys composed of high-strength copper-chromium-zirconium or ductile copper-silver are nowadays generally used for producing casting molds for continuous casting, depending of the specific application. The requirements which the materials used to have meet are becoming steadily more demanding since the throughputs of the casting plants are being increased ever further. This applies in particular to high-throughput casting plants having very high casting speeds, e.g. thin slab casting plants.

Copper alloys and their use for casting molds are disclosed in WO 2004/074526 A2 or US 2015/0376755 A1. The copper alloys disclosed there have chromium contents of up to 0.40% by weight and 0.6% by weight, respectively.

Despite refined structural design of the casting molds, the extremely high thermal stresses and large temperature changes occurring during use produce a very great stress on the mold materials. A frequent cause of failure in the case of relatively high-strength materials such as CuCrZr is incipient crack formation due to the prevailing combination of thermal and mechanical fatigue. This generally occurs in the bath surface region, in which the highest thermal stresses are present. In the case of softer, more ductile materials such as copper-silver, on the other hand, crack formation generally does not occur but instead undesirable permanent plastic deformation of the casting mold, known as bulging, occurs. This is caused by high mechanical stresses due to different thermal expansions within the casting mold. Permanent deformations occur when the strength of the material, i.e. the yield point, is exceeded by these stresses.

Owing to the effects indicated above, the operating life requirements frequently cannot be adhered to or the throughput of the casting plant cannot be increased further. Similarly disadvantageous effects can occur in the use of copper alloys for thermally and mechanically highly stressed, electric power-conducting components in welding technology, e.g. for welding electrodes, welding caps, welding rollers, electrode holders or welding nozzles.

Proceeding from the prior art, it is an object of the invention to provide a copper alloy which when used for a casting mold or a casting mold component achieves a high throughput capability and improved operating life.

SUMMARY OF THE INVENTION

This object is achieved by a copper alloy as set forth hereinafter.

According to the invention, the copper alloy includes, in percent in weight (proportion by mass of the melt analysis in %), of 0.020-0.50 of silver (Ag), 0.050-0.50 of zirconium (Zr), not more than 0.060 of phosphorus (P), not more than 0.005 of chromium (Cr) with the balance being copper (Cu) and other alloying elements including unavoidable impurities, where the proportion of other alloying elements is less than or equal to (≤) 0.50.

The copper material proposed according to the invention is a copper alloy having a high thermal conductivity, satisfactorily high strength and retarded crack initiation and growth. The electrical conductivity is in the range from 50 to 54 MS/m.

A particularly advantageous embodiment of the copper alloy includes, in percent by weight (proportions by mass of the melt analysis in %), of 0.080-0.120 of silver (Ag), 0.070-0.200 of zirconium (Zr), 0.0015-0.025 of phosphorus (P), not more than 0.005 of chromium (Cr) with the balance being copper (Cu) and other alloying elements including unavoidable impurities, where the proportion of other alloying elements is less than or equal to 0.10.

One aspect of the invention provides for the chromium content to be less than or equal to (s) 0.005% by weight. The chromium content of the copper alloy of the invention is kept below 0.005% by weight, since chromium in the copper alloy system is precipitated as secondary phases which are brittle and can adversely affect the fatigue strength of the copper alloy. The low-alloy copper-zirconium-silver (CuZrAg) material provided according to the invention surprisingly displays very advantageous properties for casting molds or components of casting molds, in particular mold plates. The silver content increases the creep strength of the casting molds or casting mold components made of the copper alloy. The zirconium content in the system combines high conductivity with strength values which are unusual for copper materials having a low alloying element content. The strength increase is achieved by means of a combination of the mechanisms of mixed crystal strengthening (by Ag), cold forming of from 10 to 50% and in particular in the range from 10 to 40% and precipitation hardening (by Zr in the form of CuZr and/or ZrP precipitates). The zirconium in particular is very effective here. Although the alloying-in of zirconium in the amount according to the invention brings about a small decrease in the ductility and also the thermal and electrical conductivity, it results in a useful increase in the strength, the thermal stability and the tribological resistance.

Furthermore, the copper material of the invention has a high softening temperature of 530° C., measured in accordance with DIN ISO 5182.

An advantageous copper alloy has a zirconium content (Zr) of 0.130% by weight, a silver content (Ag) of 0.1% by weight and a phosphorus content (P) of 0.0045% by weight. In the case of such a copper alloy, a hardness of 97 HBW 2.5/62.5 and an electrical conductivity of 53.7 MS/m were measured.

The low-alloy copper material having contents of silver and zirconium up to 0.50% by weight particularly prominently displays properties which are suitable for use in casting molds or casting mold components. These include improved strength and a high thermal softening resistance combined with virtually constant thermal conductivity. The copper material also displays an improved fatigue resistance compared to copper-chromium-zirconium alloys (CuCrZr).

The material of a casting mold or of a casting mold component is subjected to very high thermal stress on the casting side during use. In the case of relatively soft materials such as CuAg, the stresses which arise frequently lead to a plastic flow of the material in this region (bulging). Owing to the higher strength of the copper alloy of the invention compared to CuAg, this deformation does not occur or occurs to a significantly smaller extent than is the case for CuAg. The improved thermal conductivity compared to a CuCrZr alloy also brings about a reduced temperature level on the casting side, which in turn reduces the stresses present there. Crack initiation by means of stress peaks as in the case of CuCrZr takes place more slowly.

The strength and the softening resistance can be set in a targeted manner by means of the alloy composition, cold forming and appropriate hardening parameters. This makes it possible to produce casting molds or casting mold components, for example mold plates, which firstly allow a certain degree of recrystallization on the hot side on which they come into contact with the metal melt during use and thereby achieve favorable fatigue properties and, secondly, do not display any plastic deformation on the cold side where they come into contact with cooling medium because of the increased strength.

For the purposes of the invention, a copper alloy in the moderate hardness range is considered to be advantageous because retarded crack initiation and retarded crack growth is to be expected here. Hardness values in the region of 110 HBW are achieved. These values are thus between the typical values for copper alloys for casting molds or for casting mold components. The conductivity of the copper alloy according to the invention of up to 95% IACS is above that of CuCrZr and approximately in the region of CuAg materials. However, the softening resistance of >500° C. is, on the other hand, astonishingly in the region of CuCrZr materials. Such a combination is very positive for use of the copper alloy of the invention as material for casting molds or casting mold components, in particular for chill molds.

The copper alloy can be hot-formed and/or cold-formed after casting. Quenching from the forming temperature is advisable in order to set a small grain size. A separate solution heat treatment leads to a coarser microstructure, possibly to secondary recrystallization. To set a moderate strength, cold forming should be carried out before and optionally after hardening. Hardening is carried out at from 350 to 500° C.

The conductivity of the copper material is set by means of a heat treatment, with conductivities of up to 370 W/m·K or 50-54 MS/m being set here.

The copper alloy proposed in the context of the invention is particularly suitable as material for producing casting molds or casting mold components. An example of a casting mold component is a mold plate. Casting molds according to the invention can be used for continuous casting of blocks, billets, slabs, in particular thin slabs. Furthermore, other casting molds or casting mold components such as casting wheels, casting drums and casting rollers or else melting crucibles can also be produced from this material.

Use for components of welding technology, e.g. welding electrodes, welding caps, welding rollers or welding nozzles, is likewise conceivable because of the advantageous properties of the material.

What is claimed is:

1. A method, comprising:

producing a casting mold or casting mold component from a copper alloy consisting of, in percent by weight (proportion by mass of a melt analysis in %):

Silver (Ag) 0.020-0.50

Zirconium (Zr) 0.050-0.50

Phosphorus (P) 0.0015-0.025

Chromium (Cr) not more than 0.005, balance copper (Cu) and other alloying elements including unavoidable impurities, with a proportion of the other alloying elements being less than or equal to (≤) 0.50;

casting the copper alloy;

hot forming the copper alloy at a forming temperature in a range from 600 to 1000° C.;

quenching the copper alloy from the forming temperature at 50 to 2000 K/min;

cold forming the copper alloy by 10 to 50%; and hardening the copper alloy at a temperature of 350 to 500° C.

2. The method of claim 1, further comprising cold forming the copper alloy after hardening.

3. The method of claim 1, further comprising:

after undergoing the casting operation, solution heat treating the copper alloy at a temperature in a range from 600 to 1000° C.

4. The method of claim 3, further comprising cold forming the copper alloy after hardening.

5. The method of claim 1, further comprising casting a metal melt with the casting mold or casting mold component, wherein the casting mold or casting mold component in one region in contact with the metal melt softens and/or recrystallizes under thermal influence of the metal melt, whereas in another region in contact with a cooling medium, the casting mold or casting mold component has a strength which is higher than a strength of the one region.

* * * * *